US005124534A

United States Patent [19]

Williams et al.

[11] Patent Number: 5,124,534

[45] Date of Patent: Jun. 23, 1992

[54] HEATING COIL SUPPORT AND INSULATION MECHANISM

[75] Inventors: Steven E. Williams; Donald G. Leeman, both of Murfreesboro, Tenn.

[73] Assignee: Lennox Industries Inc., Murfreesboro, Tenn.

[21] Appl. No.: 718,955

[22] Filed: Jun. 21, 1991

[51] Int. Cl.[5] ..... H05B 3/06

[52] U.S. Cl. ..... 219/532; 219/536; 219/542; 174/138 J; 174/175; 338/304; 338/318

[58] Field of Search ..... 219/532, 536, 542; 174/138 J, 175; 411/349, 549, 553; 292/59; 403/348, 349; 338/304, 318, 317

[56] References Cited

U.S. PATENT DOCUMENTS 4,363,959 12/1982 Cottrell et al. ..... 219/532
4,692,599 9/1987 Howard et al. ..... 219/532

FOREIGN PATENT DOCUMENTS 1040289 9/1983 U.S.S.R. ..... 219/532
292665 10/1927 United Kingdom ..... 403/349

*Primary Examiner*—Bruce A. Reynolds
*Assistant Examiner*—Michael D. Switzer
*Attorney, Agent, or Firm*—Allegretti & Witcoff, Ltd.

[57] ABSTRACT

The improved heating coil support and insulation mechanism of the present invention is intended for use in regard to electrical heating assemblies which include heating coils supported and electrically insulated by means of coil support insulators, and each of which includes an insulator body and coil engagement means attached to the insulator body for engaging the convolutions of the heating coil. In the improvement of the present invention support rods have a locking projection disposed from a longitudinal surface thereof. The insulator body has a pair of support rod apertures extending therethrough, which have a rod support locking projection accommodation slots therein for initially receiving passage therethrough of the locking projection of the support rod. The locking projection on the support rod, upon initial insertion, is matingly disposed with respect to the support rod locking projection accommodation slot for passage therethrough and thereafter is disposed at a radial angle rotationally therefrom to prevent relative longitudinal movement between the insulator body and the support rod.

20 Claims, 2 Drawing Sheets

Fig.1
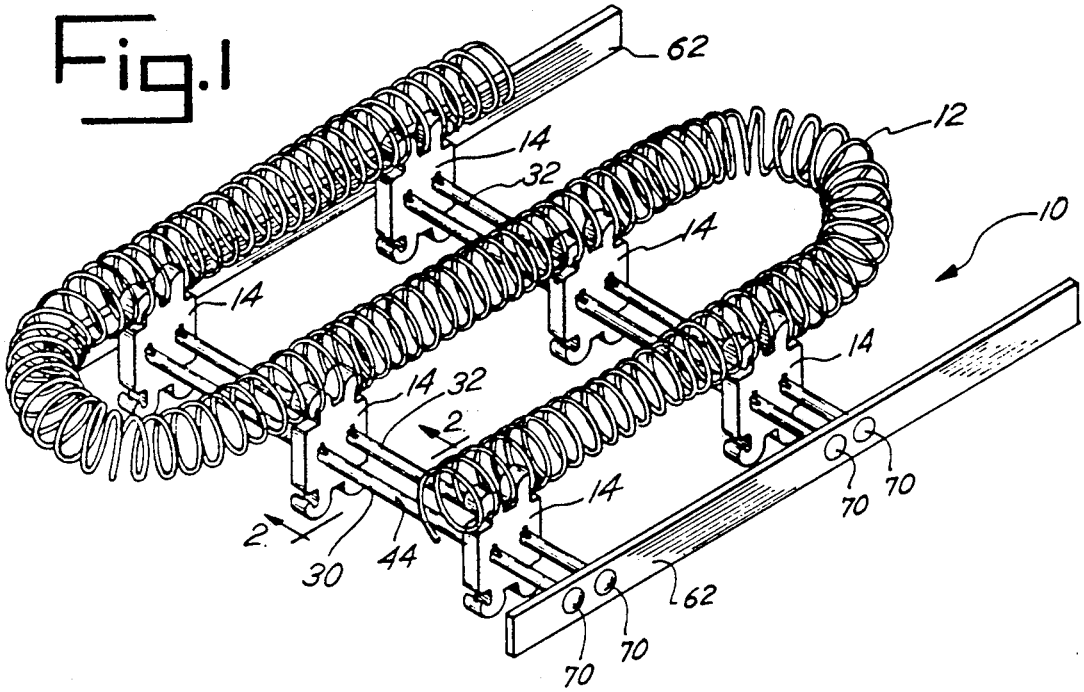
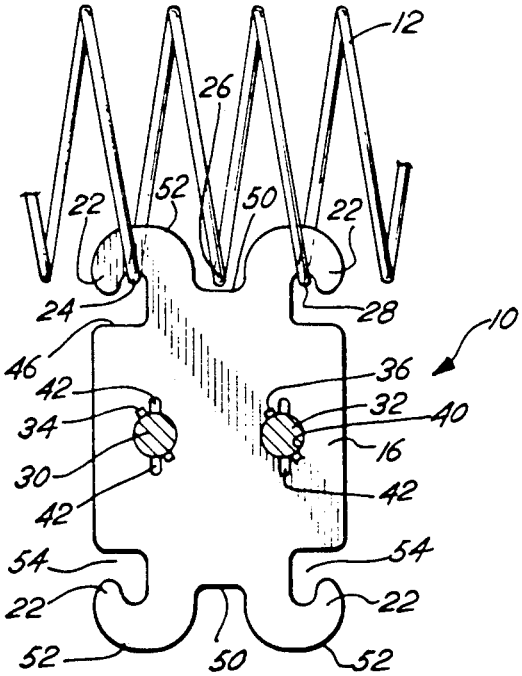
Fig.2
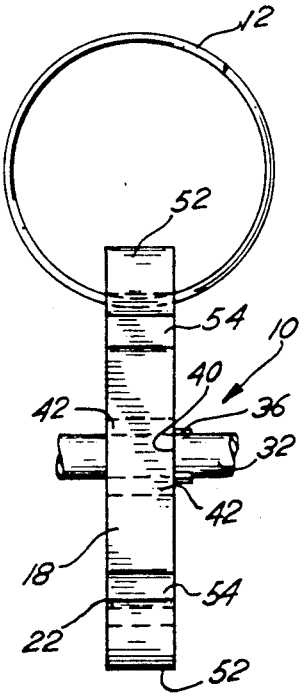
Fig.3
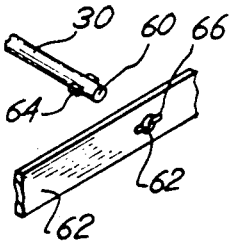
Fig.4

HEATING COIL SUPPORT AND INSULATION MECHANISM

BACKGROUND OF THE INVENTION

The present invention relates generally to electric heaters, and more particularly to an improved support and electrical insulation mechanism for the heating coils of an electrical resistance heater.

In the prior art, several different mechanisms have been proposed for the support and electrical insulation of the heater coils of an electrical resistance heater. These prior art mechanisms typically have involved the use of a plurality of non-electrically conductive coil support insulators, such as maybe made for example of a ceramic material. Typically, the prior art coil support insulators have necessitated means for engaging and holding convolutions of the heating coil, and also have required means for holding a plurality of such coil support insulators in spaced array to support one or more heating coils over the extent of their respective lengths.

One form of prior art heating coil support mechanism is set forth in U.S. Pat. No. 4,692,599, and as reexamined B1 4,629,599, wherein a plurality of coil support insulators are held in spaced array by a pair of rods which engage grooves in the sides of the coil support insulator, and which rods are bent into a channel-shape to encircle the insulator by extending along and across its front and back faces.

Another form of coil support insulator is set forth in U.S. Pat. No. 3,798,417, which shows a generally flat coil support element containing an aperture therethrough, through which a serrated support rod is disposed, and which support rod is held in place by a V-shaped clip disposed laterally around a side and both faces of the coil support insulator.

Another form of coil support mechanism is taught in U.S. Pat. No. 4,250,399, wherein a plurality of generally flat-bodied coil support insulators are disposed from transversely extending clips, which in turn are held in position by externally disposed rods.

In addition to the above examples of coil support insulator mechanisms, the prior art teaches a wide variety of other forms of coil support and insulator structures, some of which function more effectively than others. However, notwithstanding the progress of the coil support insulator arts, further improvements have been indicated in regard to the ease, cost and efficiency of production, usability, replaceability versatility, functionality, reliability, inter alia, of these prior arts systems.

In view of the defects, deficiencies and/or disabilities of the prior art coil support insulator structures, it is a material object of the improved heating coil support and insulation mechanism of the present invention to alleviate substantially such prior art problems.

It is a further object of the present invention to provide a coil support structure which generally includes a pair of support rods having at least one locking projection extending from one longitudinal surface of one of said support rods, and respectively inserted into a pair of support rod apertures in the insulator body, and upon twisting of the rod with the projection thereon for locking the support rod and the insulator body into a substantially fixed longitudinal relationship.

It is another object of the improved heating coil support and insulation mechanism of the present invention to provide a coil support structure which includes a pair of support rods having projections for positioning on either side of the support rod apertures in the insulator body for locking the support rod and the insulator body into a substantially fixed longitudinal relationship.

It is a further object of the improved heating coil support and insulation mechanism of the present invention to provide for the versatility of a field replacable coil support insulator, whereby upon damage to a support insulator, a replacement insulator could be merely "twisted" into functional position, without the necessity for insertion of the support rod into a support rod aperture by means of respective longitudinal motion therebetween, and whereby such field repairability is materially enhanced, and further without the necessity for removing the entire module comprising a multiplicity of coils with their associated support structures from the electrical resistance heater.

These and other objects and advantages of the improved heating coil support and insulation mechanism of the present invention will become apparent to those skilled in the art upon review of the following summary of the invention, brief description of the drawing, detailed description of preferred embodiments, appended claims, and accompanying drawings.

SUMMARY OF THE INVENTION

The improved heating coil support and insulation mechanism of the present invention is intended for use in regard to electrical heating assemblies incorporating heating coils for heating by means of electrical resistance. Such electric heaters include heating coils which are supported and electrically insulated by means of coil support insulators, each of which includes an insulator body and coil engagement means attached to the insulator body for engaging the convolutions of the heating coil. In some preferred embodiments, the coil engagement means may be of a "rams-horn" shape, although other coil engagement shapes are contemplated.

The improvement of the present invention is directed to a pair of support rods at least one of which has a locking projection disposed from a longitudinal surface thereof. The insulator body has a pair of support rod apertures extending therethrough, and at least one of which has a rod support locking projection accommodation means therein for initially receiving passage therethrough of the locking projection of the support rod. The locking projection on the support rod, upon initial insertion, is matingly disposed with respect to the support rod locking projection accommodation means for passage therethrough and thereafter is disposed at a radial angle rotationally therefrom to prevent relative longitudinal movement between the insulator body and the support rod in at least one longitudinal direction.

In a preferred embodiments of the present invention, the support rod apertures with accompanying support rod locking projection accommodation means may be generally "double-keyhole" shaped, and the support rod may have a pair of matching double-keyhole shaped crimps disposed longitudinally thereon, such that the support rod may be inserted into the double-keyhole shaped aperture until the first of the two double-keyhole shaped crimp passes therethrough, whereafter the rod is twisted radially (and approximately 90° in some embodiments) in order to lock the insulator body onto and to prevent longitudinal movement of the insulator body with respect to the support rod.

BRIEF DESCRIPTION OF THE DRAWING

The improved heating coil support and insulation mechanism of the present invention is shown in the accompanying drawing, and in which common numerals are utilized for common elements throughout, and in which:

FIG. 1 is a perspective view of the heating coil support and insulation mechanism of the present invention, showing the coil support insulators disposed on respective support rods, which in turn are supported by a frame, and showing the heating coil support insulators engaging a heating coil at the top portion thereof, with the heating coil to be disposed at the bottom portion thereof not shown;

FIG. 2 is an enlarged fragmented transverse cross-sectional view taken along line 2—2 of FIG. 1, and showing the heating coil support insulator supporting three consecutive convolutions of the heating coil by means of coil engagement hooks having curved guide surfaces thereon, and further showing a pair of support rods having locking projections thereon extending through support rod apertures disposed in the insulator body;

FIG. 3 is an enlarged side view of the embodiment hereof as shown in FIG. 2, and showing the heating coil engaged at the top portion of the heating coil insulator body by means of coil engagement hooks, having curved guide surfaces extending away from the insulator body and terminating in a coil holding notch;

FIG. 4 is a fragmented perspective view of one embodiment of a locking mechanism for holding the support rods within the frame, such as shown in FIG. 1, prior to spin forming of the exterior ends thereof;

DETAILED DESCRIPTION OF PREFERRED EMBODIMENTS

Figure 5:
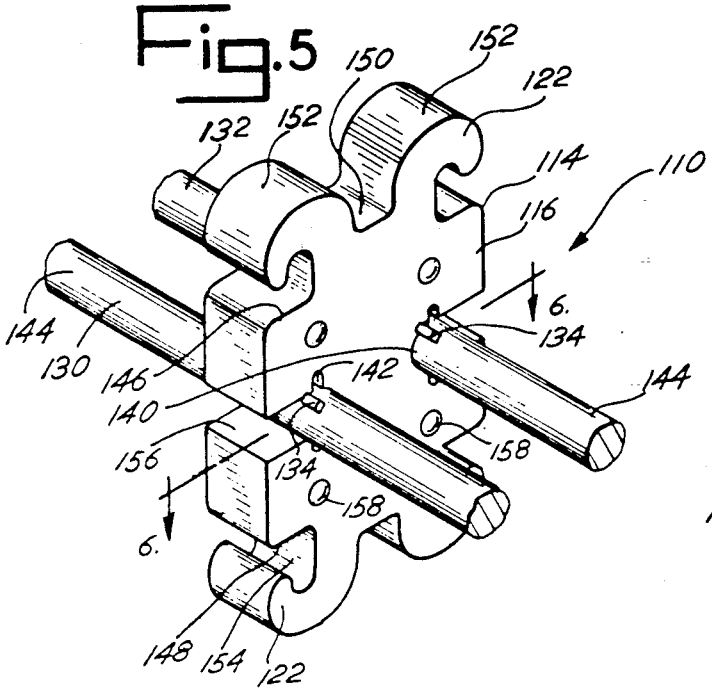
FIG. 5 is an enlarged perspective view of an alternative embodiment of the heating coil support insulator hereof especially adapted for field replaceability purposes, and illustrating side notches in the lateral sides of the insulator body and communicating with the support rod apertures for engagement of the support rod with the support rod aperture through the side notches, such as may be utilized in replacing a heating coil support insulator which has become broken.
Figure 6:
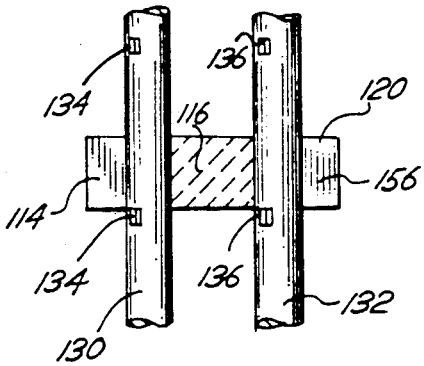
FIG. 6 is a transverse cross-sectional view taken along line 6—6 of FIG. 5, and showing the support rods having locking projections extending from a longitudinal surface thereof, which have been rotated at a radial angle to prevent relative longitudinal movement between the insulator body and the support rod.

Referring now to the drawing and to FIGS. 1–4 in particular, the present invention is directed to an improved heating coil support and insulation mechanism generally 10 for use in connection with an electrical heater which incorporates heating coils 12 as shown in FIGS. 1–3 for heating by means of electrical resistance. An alternative embodiment of the improved heating coil support and insulation mechanism 110, which has special utility for field repairability applications, is depicted in FIGS. 5–8 hereof. It should be noted that the various elements of the field repairability embodiment (as shown in FIGS. 5–8 hereof) which correspond to elements of the "permanently installed" embodiment of FIGS. 1–4 are identified by the number thereof plus 100. Accordingly, the description of these corresponding elements set forth in FIGS. 1–4 need not be repeated in haec verba with regard to the embodiments shown in FIGS. 5–8.

Heating coils 12 are supported and electrically insulated by a plurality of coil support insulators 14. As shown in FIGS. 2 and 3, coil support insulator 14 has an insulator body 16 with opposed front and back faces 18,20. Coil engagement hooks 22 are attached to insulator body 16 for engaging the convolutions 24,26,28 of heating coil 12. In the present invention, a pair of support rods 30,32 are provided, which have laterally spaced locking projections 34,34 extending from longitudinal surface 38 thereof. There may be two opposed locking projections 34 on support rods 30,32 as shown, or alternatively there may be two spaced apart projections 34,34—one on each side of the insulator body. The projections 34,34 are spaced apart a distance slightly greater than the thickness of the insulator body 16 to properly position each insulator on the rods and to permit a limited movement of the insulator body to prevent cracking or damage to the insulator body in the vent of contractions of the support rods in use. Also it is noted that there need not be projections 34 on both rods 30,32, but there may be projections 34 on only one of the rods. Each insulator body 16 has a pair of support rod apertures 40 extending therethrough. Accomodation slots 42,42 for receiving passage therethrough of locking projection 34 of support 30 may be provided on alternative embodiments. Each locking projection 34 on support rod 30 is crimped initially after insertion.

Thereafter, locking projection 34 on support rod 30 is disposed at a radial angle rotationally therefrom, by rotational twisting of the support rod to prevent relative longitudinal movement between insulator body 16 and support rod 30 in at least one longitudinal direction, and preferably in both longitudinal directions. In certain preferred embodiments, a pair of locking projections 34,34 are disposed in longitudinally spaced array on support rod 30, for respective disposition on front face 18 and back face 20 of coil support insulator 14, in order to prevent longitudinal movement in both longitudinal directions.

As shown in FIG. 1, a plurality of coil support insulators 14 are provided, and a pair of locking projections 34,34 extends longitudinally from surface 44 of support rod 30 in the same longitudinal plane for insertion without rotation of support rod 30 through at least two coil support insulators 14.

As shown in FIG. 2 in particular, a plurality of locking projections 34,34 are disposed in equiradial array about support rod 30, although other non-equiradial arrays are contemplated as being within the scope of the present invention. The plurality of equiradially disposed locking projections 34,34 are preferably be disposed in a common transverse plane of support rod 30, although other arrangements thereof likewise are contemplated.

Once such support rod 30 having locking projections 34 disposed on longitudinal surface 44 thereof is utilized, the other matching support rod to be inserted may be substantially smooth in its longitudinal dimension. Thus, in their interactive functions, the two matching support rods 30,30 prevent rotation of the support insulator, as well as longitudinal movement on support rods 30,30 with respect to coil support insulator 14. Of course, a support rod 30 may be substantially symmetrical for example, a cylindrical cross-sectional shape, although other cross-sectional shapes are contemplated. Further the support rods 30,32 may be solid or tubular.

As shown in FIGS. 2 and 5 in particular, the support rod apertures 40 are disposed at a substantially equal distance between the top 46 and the bottom 48 of faces 18,20 thereof. In these and other preferred embodiments, support insulator 30 has a longitudinal axis and support rod apertures 40 are further disposed a substantially equal distance laterally of the longitudinal axis of support insulator 14, as shown particularly in FIG. 2.

Coil engagement hooks 22 are formed integrally with the insulator body 16 and extend from the longitudinal top 46 and bottom 48 of insulator body 16. Coil engagement hooks 22,22 are disposed for engaging two spaced convolutions 24,28 of heating coil 12. Coil engagement hooks 22,22 are separated by a coil engagement slot 50 for engaging a convolution 26 of heating coil 12. Coil engagement hooks 22,22 may be preferably formed integrally with insulated body 16. Each of coil engagement hooks 22 has curved guide surfaces 52 extending away from insulator body 16 and terminating in a coil holding notch 54. Guide surfaces 52 engage a convolution 24,28 of heating coil 12, and upon pushing engagement hook 22 into coil 12 for guiding the convolution 24,28 along curved guide surface 52 to coil holding notch 54 secures convolution 24, 28 of heating coil 12 therein. In these embodiments curved guide surfaces 52 are substantially semi-circular in shape. The distance between the notch 54 and the slot 50 is greater than the untensioned distance between adjacent convolutions of the heating coil 12. The purpose of this arrangement is to help properly secure the heating coil to the insulators in normal operation.

Figure 7:
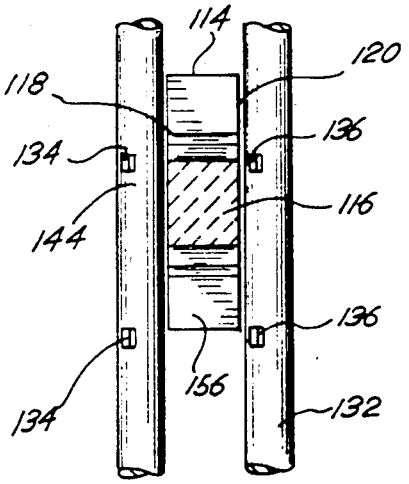
FIG. 7 is an illustration of the beginning positioning of the field replacable embodiment of the coil support insulator as shown in FIG. 5.
Figure 8:
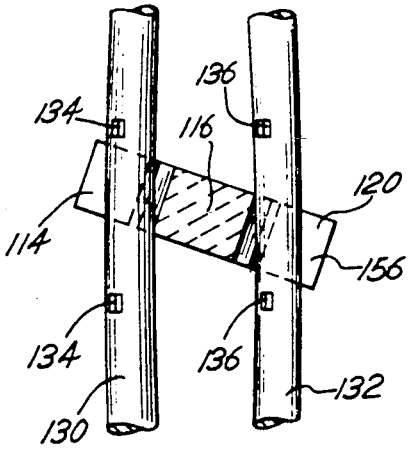
FIG. 8 is an enlarged cross-sectional view of the field replacable embodiment of the coil support insulator as shown in FIGS. 5, 6 and 7, illustrating the twisting of the field replacable embodiment hereof into position for replacement in the field of a broken insulator.

In the preferred embodiments depicted in FIGS. 5–8, a side notch 156 is disposed in the side of insulator body 116 and communicates with the corresponding support rod aperture 140 for engagement of support rod 130 with the support rod aperture 140 through side notch 156. By means of such structure, coil support insulator 114 may be disposed by lateral relative motion constituting a twisting motion onto stationarily disposed support rods 130 as shown progressively respectively in FIGS. 7, 8 and 6. In these embodiments, such disposition engages heating coil 112 without the necessity for respective longitudinal movement between support rod 130 and insulator body 114. In particular, FIG. 7 shows an illustration of the beginning positioning of the field replacable embodiment of the coil support insulator as shown in FIG. 8 shows the twisting of the field replacable embodiment thereof of coil support insulator 114 into position for field replacement of a broken insulator.

As shown in FIG. 5, insulator separators 158 are disposed on face 118 of insulator body 116 for stackable separation of a plurality of support insulators 114. Of course, the insulator separator 158 may take a wide variety of shapes, such as a plurality of small hemispheres, a pair of raised ridges disposed across face 118 of insulator body 116, etc. FIG. 4 depicts one means for securing and supporting the ends 60 of support rods 30 to a frame 62, which ultimately supports the coils 12, and which may be utilized to define a modular heating coil assembly. In particular, ends 60 of support rods 30 are given crimps 64 to correspond to crimp holders 66 which communicate with support rod end aperture 68. After insertion of end 68 of support rod 30 into support rod end aperture 68, end 60 is then spin-formed by heat and friction by known means to form spin-formed domes 70,70, as shown in FIG. 1.

Of course, the various materials utilized for the elements of the improved heating coil support and insulation mechanism of the present invention are known to those skilled in the art. Moreover, it will be appreciated by those skilled in the art that the various surfaces and shapes thereof may be modified without departing from the spirit and scope of the present invention, for example. Yet further, the basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. In an electrical heater incorporating heating coils for heating by means of electrical resistance and being supported and electrically insulated by coil support insulators, the support insulators having an insulator body with opposed front and back faces and coil engagement means attached to the insulator body for engaging the convolutions of the heating coil, the improvement comprising:

a pair of support rods, at least one of which has at least one locking projection extending from the longitudinal surface thereof, said support rod pair extending longitudinally of said front and back faces of said insulator body, with a plurality of said insulator bodies disposed in longitudinal array on said pair of support rods;

each said insulator body having a pair of support rod apertures extending therethrough, at least one of said pair of support rod apertures having support rod locking projection accomodation means therein for initially receiving passage therethrough of said at least one locking projection of said at least one support rod, said support rods extending longitudinally of said front and back faces of each said insulator body and disposing a plurality of insulator bodies thereon in longitudinal array; and said at least one locking projection on said at least one support rod initially upon insertion matingly disposed with respect to said at least one support rod locking projection accommodation means for passage therethrough and thereafter for disposition at a radial angle rotationally therefrom to prevent relative longitudinal movement between said each insulator body and said at least one support rod in at least one longitudinal direction, and wherein said at least one locking projection is disposed as pairs of locking projections in longitudinally spaced array on said at least one support rod, for respective disposition adjacent the front face and the back face of said each insulator body, whereby relative longitudinal movement between said insulator bodies and said at least one support rod is prevented in both longitudinal directions.

2. The improvement of claim 1 further comprising at least two support insulators and wherein said pair of locking projections comprise first and second locking projections, and said first and second locking projections each extend longitudinally from the surface of said support rod in the same longitudinal plane for insertion without rotation of said support rod through said at least two coil support insulators.

3. The improvement of claim 1 further comprising at least two support insulators and further comprising on said support rod corresponding locking projections for each respective coil support insulator, said corresponding locking projections each extending longitudinally from the surface of said support rod in the same longitudinal plane for insertion without rotation of said support rod through said at least two coil support insulators.

4. The improvement of claim 1 further comprising at least one locking projection comprises a plurality of locking projections disposed in equiradial array about said support rod.

5. The improvement of claim 4 wherein said plurality of equiradially disposed locking projections are disposed in a common transverse plane of said support rod.

6. The improvement of claim 1 wherein one support rod of said pair of support rods has a locking projection disposed from the longitudinal surface thereof, and said other support rod is substantially smooth in its longitudinal dimension.

7. The improvement of claim 1 wherein at least one of said pair of support rods is substantially cylindrical in shape.

8. The improvement of claim 1 wherein said support rod apertures are disposed substantially equidistant between the top and the bottom of the faces thereof.

9. The improvement of claim 8 wherein said support insulator has a longitudinal axis and wherein said support rod apertures are further disposed a substantially equal distance laterally of said longitudinal axis of said coil support insulator.

10. The improvement of claim 1 wherein said coil engagement means comprise a pair of opposed coil engagement hooks attached to at least one longitudinal end of said insulator body.

11. The improvement of claim 10 wherein a pair of coil engagement hooks is attached at each longitudinal end of said insulator body for receiving or supporting a heating coil at the end.

12. The improvement of claim 10 wherein a pair of coil engagement hooks is disposed for engaging two spaced convolutions of the heating coil, said pair of coil engagement hooks separated by a coil engagement slot for engaging a convolution of the heating coil disposed intermediate of said two spaced convolutions of the heating coil.

13. The improvement of claim 10 wherein a pair of coil engagement hooks are formed integrally with said insulator body.

14. The improvement of claim 10 wherein each of said coil engagement hook comprises curved guide surface means extending away from said insulator body and terminating in a coil holding notch, said guide surface means (a) for engaging a said convolution of said heating coil, and (b) upon pushing said engaged coil engagement hook into said coil, for guiding said convolution along said curved guide surface means to said coil holding notch for securement of said convolution of said heating coil therein.

15. The improvement of claim 14 wherein said curved guide surface means are substantially semicircular in shape.

16. The improvement of claim 12 wherein said two spaced convolutions and said intermediate convolution of said heater coil constitute three consecutive convolutions of said heater coil.

17. The improvement of claim 1 further comprising at least one side notch means disposed in the sides of said insulator body and communicating with a corresponding said support rod aperture for engagement of said support rod with said support rod aperture through said side notch means, whereby a coil support insulator may be disposed by lateral relative motion onto a stationarily disposed said support rod and for engaging said heater coil without the necessity for respective longitudinal movement between said support rod and said insulator body.

18. The improvement of claim 1 further comprising at least one insulator separation means disposed on a face surface of said insulator body for stackable separation of a plurality of coil support insulators.

19. The improvement of claim 1 further comprising a frame and wherein said support rods include frame attachment means disposed at respective longitudinal ends thereof for attaching said support rods to said frame.

20. The improvement of claim 19 wherein said frame attachment means respectively comprise spin-formed domes.

* * * * *